United States Patent [19]

Levis et al.

[11] 4,001,555

[45] Jan. 4, 1977

[54] SIGNAL PROCESSING APPARATUS

[75] Inventors: Peter Stanley Levis, Bramhall; Geoffrey Shepherd, Oldham, both of England

[73] Assignee: Ferranti Limited, Hollinwood, England

[22] Filed: Sept. 5, 1975

[21] Appl. No.: 610,848

[30] Foreign Application Priority Data

Sept. 6, 1974 United Kingdom ..... 38948/74

[52] U.S. Cl. ..... 235/150.53; 235/152; 235/197

[51] Int. Cl.[2] ..... G06G 7/28

[58] Field of Search ..... 235/150.5, 150.52, 150.53, 235/152, 197

[56] References Cited

UNITED STATES PATENTS

| | | | |
|---|---|---|---|
| 3,345,505 | 10/1967 | Schmid | 235/197 |
| 3,373,273 | 3/1968 | Schubert | 235/150.53 X |
| 3,412,240 | 11/1968 | Hunt et al. | 235/152 X |
| 3,480,767 | 11/1969 | Howe | 235/150.53 |
| 3,678,258 | 7/1972 | Patmore et al. | 235/150.53 |
| 3,729,625 | 4/1973 | Inoue | 235/197 |
| 3,821,524 | 6/1974 | Wahl | 235/152 X |
| 3,831,011 | 8/1974 | Hulme | 235/151.34 |

*Primary Examiner*—Jerry Smith
*Attorney, Agent, or Firm*—Cameron, Kerkam, Sutton, Stowell & Stowell

[57] ABSTRACT

For weighting input signal in accordance with a mathematical transfer function represented by a plurality of straight lines each of which intersects the next at a separate break-point, signal processing apparatus receives or generates a train of pulses, the number of pulses received over a sampling period being related to the signal, and detects preset numbers of pulses corresponding to the break-points, the number detected at the end of the sampling period identifying the highest break-point reached. The detection of each break-point is used to produce an analogue signal corresponding to the value of the break-point and a voltage source is selected corresponding to the gradient of the straight line section following the break-point. Pulses received after each break-point are counted, to be re-set at the next break-point, and the total at the end of the sampling period multiplied by the gradient in a D/A converter to give the analogue value of the signal in excess of the highest break-point. The two analogue signals are summed to provide output signal of the input signal as weighted by the function.

14 Claims, 6 Drawing Figures

SIGNAL PROCESSING APPARATUS

This invention relates to signal processing apparatus in which an information input signal is weighted in accordance with a mathematical transfer function.

Processing apparatus is known in which a signal is weighted in accordance with a transfer function, comprising, or approximated by, a plurality of straight line sections, by analogue and by digital methods. A typical analogue apparatus employs a resistive potential divider between input and output terminals, one or more arms of the divider having a plurality of resistors of different values connected in parallel and each of which may be switched into the circuit in turn as the input signal increases. Switching is normally achieved by means of a transistor or diode in series with each resistor and biased in a non-conducting state by a secondary potential divider; as the input variable exceeds the threshold levels required to bias the transistor or diode into conduction additional resistors are added to the potential divider to modify the output. Between each threshold level the transfer function is a straight-line section having a slope proportional to the ratio of the potential divider. Because of the interdependency between the resistor values it is not simple to make variations between the threshold levels nor to arrange for other than straight line sections which increase in gradient at each threshold. A digital form of weighting apparatus is described in British patent specification No. 1,351,305 in which the input signal in digital form is compared with one or more stored transfer functions and weighted accordingly. Such device is complex and realisable as a monolithic integrated circuit. In this form it is restricted to the transfer functions provided during manufacture.

It is an object of the present invention to provide signal processing apparatus of simple form for weighting an information input signal in accordance with a mathematical transfer function.

According to the present invention there is provided signal processing apparatus for weighting an input signal in accordance with a predetermined mathematical transfer function represented by a plurality of straight lines each of which intersects the next at a separate break-point, which apparatus comprises control means operable to define a succession of sampling periods of equal duration, input means responsive to an input signal to provide a train of pulses such that the number of pulses generated during a sampling period represents the magnitude of the input signal, detection means defining the number of pulses corresponding to each successive break-point and responsive to the number of pulses occurring during a sampling period to produce a break-point signal identifying the highest break-point defined by said number of pulses, means responsive to the break-point signal to produce a gradient signal indicative of the slope of the straight line joining the said identified break-point to the next higher break-point, counting means operable to count the number of pulses occurring in excess of the number identifying the break-point, means responsive to the number of pulses counted and to the gradient signal to provide an intermediate signal representative of the product of the input signal, in excess of the break-point, and the slope of the straight line section, and output means operable to deliver an output signal representative of the sum of the break-point signal and the intermediate signal.

The invention will now be described by way of example with reference to the accompanying drawings, in which.

Figure 1:
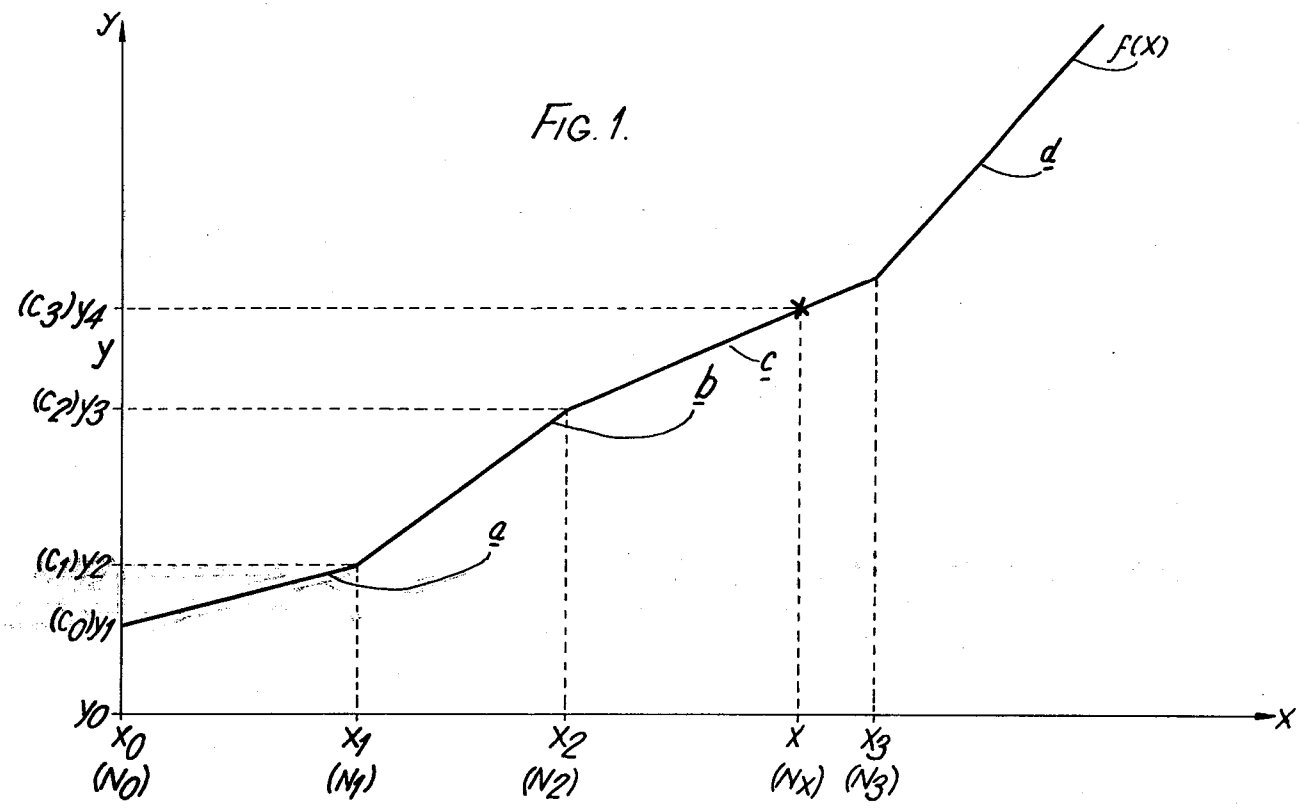
FIG. 1 illustrates the form of a typical transfer function showing the output signal level as a function of the input signal level.

Referring to FIG. 1 the relationship between an input signal $x$ and an output signal $y$, $y = f(x)$, is approximated by four straight-line sections $a$, $b$, $c$, and $d$, $x_0$, $x_1$, $x_2$, and $x_3$ denoting break-points of the function. The sections have slopes, or gradients $S_0$, $S_1$, $S_2$, and $S_3$ respectively and the corresponding values of $y$ at the break points are $C_0$, $C_1$, $C_2$ and $C_3$ respectively.

Thus for any value of x the equivalent value of y is given in general terms by $$y = S_i\,(x - x_i) + C_i \text{ for } x_i < x < x_{i+1}$$

where $i = 0, 1, 2, 3$.

Thus by setting the slopes S, break-points of $x$ and the value of constants at the break points, the value of $y$ can be obtained for any value of $x$.

Figure 2:
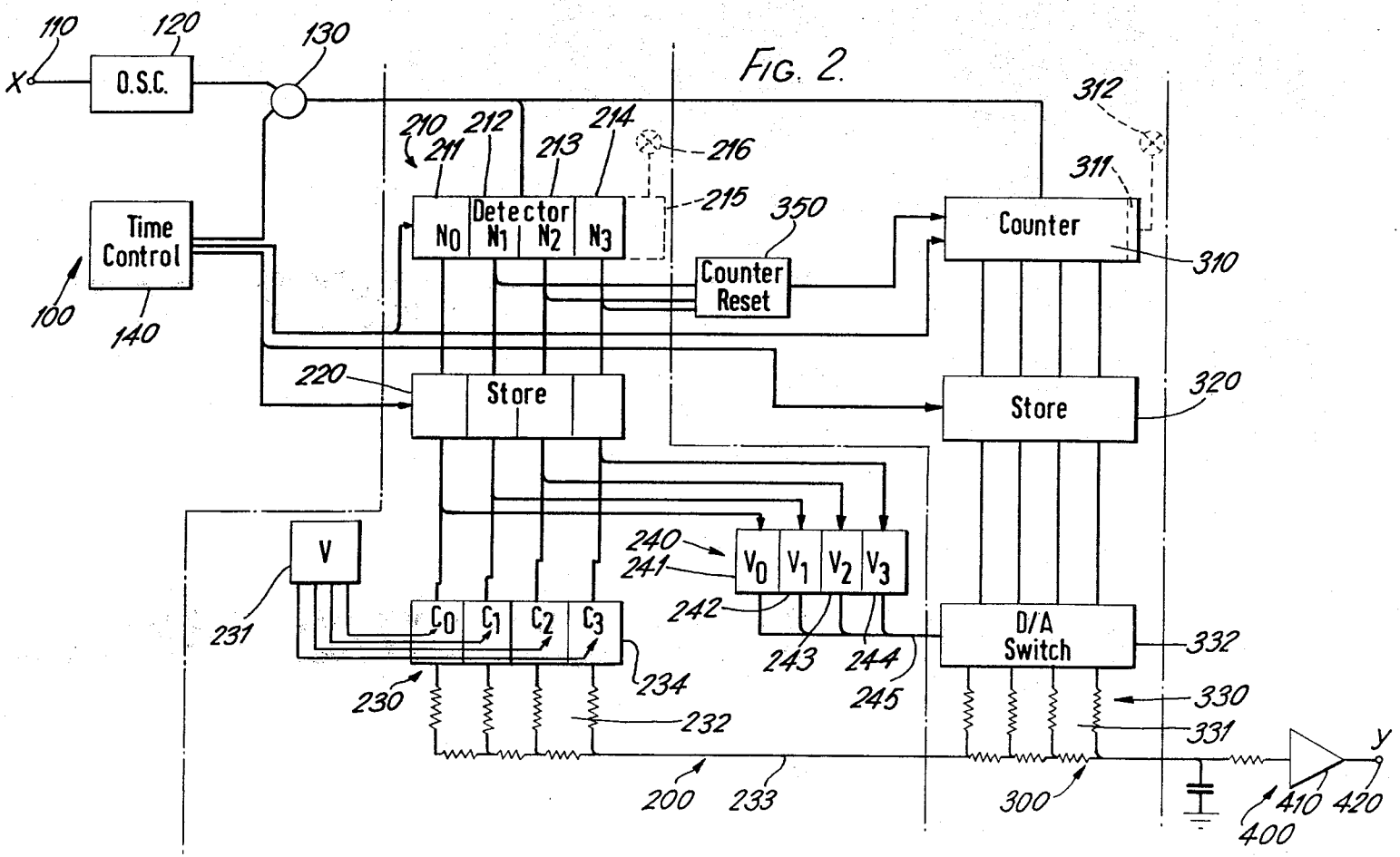
FIG. 2 is a block circuit diagram of a signal processing apparatus according to the present invention.

Referring to the circuit arrangement of FIG. 2 this may be conveniently subdivided into four sections shown as 100, 200, 300 and 400.

Section 100 is an input and control section and comprises input means comprising an input terminal 110, an oscillator 120, a gate 130 and control means comprising a control timing element 140. The control timing element 140 defines a succession of sampling periods of equal duration. The oscillator 120 is operable to provide a train of pulses the repetition frequency of which is determined by the amplitude of an analogue input signal $x$ applied to the terminal 110. The gate 130 is connected in line with the oscillator output and is caused to open and close by the timing element 140 to pass pulses only during preset sampling periods. It will be appreciated that by choosing a sampling period of suitable duration the number of pulses produced in the sampling period is directly proportional to the magnitude of $x$.

Section 200 controls the "static" parameters of the transfer function, that is, the desired break-points of the function, the values of the constants at the beginning of each straight-line section and the slope of that section. These parameters are determined externally either to agree with, or to approximate to, the $y = f(x)$ relationship and are set into the circuit before operation. This section 200 comprises detection means 210 consisting of four pulse-count detectors 211, 212, 213 and 214 to all of which detectors the oscillator pulses are applied. Different detectors are arranged to provide as an output a detection signal when particular different preset numbers $N_i$ ($i = 0, 1, 2, 3,$) of pulses identifying to break points have been produced in any one sampling period and the detectors operate in turn to maintain their output until the number reaches that at which the next detector operates. Thus individual detectors are associated with different break-points so that at the end of any sampling period the detector which is producing a detection signal is indicative of the range of values of $x$ ($x_i$ to $x_{i+1}$) within the which the actual value of $x$ lies. The detectors are connected to provide an output to individual sections of a store 220. The store is arranged to be triggered, at the end of each sampling period, by a timing signal from the element 140 to store the detection signal of whichever detector is operating at that time. The output of each section of the store is connected to a digital-to-analogue (D/A) converter 230. The D/A converter comprises a voltage source 231, a resistor network 232 connected to an output line 233, and a plurality of switches forming a switching network 234 by which the voltage source is connected to selected resistors of the network. The store 220 is arranged to provide a continuous output signal for the duration of the sampling period characteristic of whichever detector output signal is stored and the D/A converter is arranged to provide a break-point signal in analogue form and having a value $C_i$ ($i$ = 0, 1, 2, 3) related to the magnitude of the reference voltage dependent upon the range of values $x$ in which the input signal lies, that is, indicative of the highest break point defind by the number of pulses in the sampling period. The voltage applied to the switching network 234 is preset individually for each of the switches to determine the analogue levels of the constants $C_i$.

Means for providing a gradient signal shown generally at 240 comprises a plurality of individual voltage sources 241, 242, 243, 244 each connected to receive an output signal from a different detector by way of the store 220. The outputs of the voltage sources, only one of which is operable at any time, are connected together and provide gradient voltages $V_i$ ($i$ = 0, 1, 2, 3, ) representative of the slopes of the straight-line sections of the transfer function on a line 245 to an A/D converter in the section 300 and described hereinafter, each voltage level being associated with a particular break point and its constant $C_i$.

Section 300 determines the 'dynamic' parameters of the function, that is, the straight-line relationships between break-points. This section includes counting means comprising a pulse counter 310 connected to the gate 130 to receive oscillator pulses serially and operable to produce a parallel binary output, representative of the number of pulses counted, to a store 320 and a counter reset timing means 350 connected to the outputs of the detectors 210 and operable to reset the counter 310 to zero when any of the detector outputs change state. The store 320 is similar to the store 220 and is also triggered at the end of the sampling period by the timing element 140. The store 320 provides an output means for providing an intermediate signal comprising a D/A converter 330 having a resistor network 331 connected to the output line 233 and a plurality of switches 332 to which switches the voltage $V_i$ on the line 245 is applied. The voltage$V_i$ is representative of the slope $S_i$ of the relevant straight-line section and is added together in analogue form a number of times corresponding to the number of stored counter pulses, effectively to multiply the gradient of the slope by the number of pulses, to provide an intermediate signal representative of the portion of the input signal, in excess of the break-point weighted by the slope of the straight-line section.

Section 400 comprises output means and an output buffer amplifier 410 to which the output line 233, carrying the analogue break-point and intermediate signals is connected. The amplifier output signal comprising the sum of the analogue outputs is applied to an output terminal 420.

The control element 140 also provides a reset signal to the detection means 210 and counter 310 at the end of each period, after the stores 220 and 320 have been triggered.

Referring to both Figures operation of the circuit arrangement will be described in which it is desired to obtain a value of y corresponding to an input value of $x = X$, shown in FIG. 1 to be between $x = x_2$ and $x = x_3$.

Initially both stores 220 and 320 are empty and provide no output. The frequency of the oscillator is set by the input signal and at the start of the first sampling period the gate 130 is opened and pulses applied to the counter 310 and the detector 210.

After $N_o$ pulses (in this case zero) the detector 211 provides an output signal to the store 220. After $N_1$ pulses, the detector 211 ceases to provide an output and the detector 212 produces an output signal to the store; this change of output signal also resets the counter 310 to zero from where it begins to count for subsequent pulses. After $N_2$ pulses the detector 212 ceases to produces an output signal and the detector 213 produces an output signal to the store; again this change of output signal also resets the counter 310 to zero from where it begins to count for subsequent pulses. At the end of the sampling period $N_x$ pulses have been produced comprising ($N_2$ + number held in counter 310) and the values current at the end of the sampling period are entered into the stores 220 and 320 respectively. The counter 310 and detectors 210 are reset to zero for the next sampling period.

The stored values are fed to their respective D/A converters.

The store 220 contains information in the form of, say, a binary digit in its third stage corresponding to an output of the detector 213 and this is applied to the D/A converter 230 to provide a break-point signal representative of the constant $C_2$. The output of the store 200 also determines which of the voltage sources 240 is to be applied to the A/D converter 330, to which converter the output of the store 320 is applied. The contents of the store 320 comprise the number of pulses ($N_x - N_2$) along the straight-line section $c$ and represents the value ($X - x_2$). This number is effectively multiplied by the gradient of the line (representated by the voltage $V_2$) in the D/A converter and the resultant analogue signal comprising the intermediate signal added to that of the constant $C_2$.

The output signal y appearing at the terminal 420 is $Y = A.V_2.(X - x_2) + C_2$ where $V_2 \alpha S_2$, the gradient of the line, and A is the gain of the amplifier, for $x_2 < X < x_3$.

This value $y$ is produced as the output signal for the duration of the next sampling period when, if the value of $x$ has remained unchanged, the same values will be stores and $y$ will be unchanged. If at the end of the next sampling period the value of $x$ has changed then new values will be stored in one or both of the stores and the analogue output will change accordingly for the duration of the next following sampling period.

Figure 3:
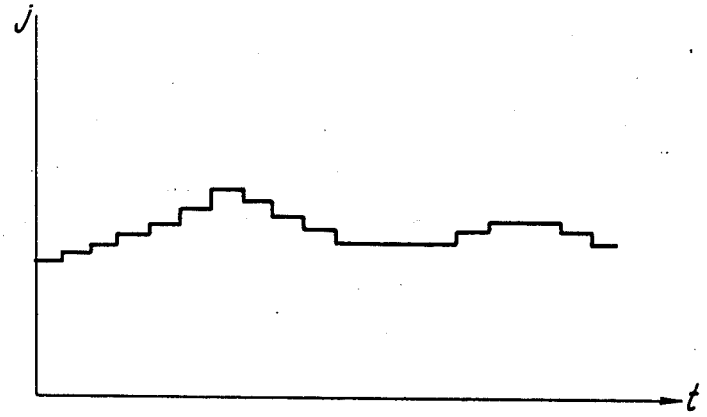
FIg. 3 illustrates a further form of transfer function.

The output signal $y$ maintains a particular level for each sampling period and it will be appreciated tht if $x$ varies continuously then the signal $y$ will vary according to the relationship $y = f(x)$ in discrete steps at intervals equal to the timing period. FIG. 3 shows the waveform of a typical output signal varying with time. The output signal ($y$) be smoothed and/or the sampling period chosen sufficiently short to make any step height between adjacent timing peiods acceptable. It will be appreciated that in any single sampling period the maximum number of pulses produced must not exceed the detection level of the most significant detector (214) or the difference between detection levels exceed the capacity of the counter 310. The frequency of the oscillator is thus required to be chosen sufficiently low not cause overflow of the detectors and counter, but high enough to give sufficient resolution in values of y between successive pulses. The counter and detection means may be provided with additional stages 215 and 311 respectively (shown ghosted) connected to indicator lamps 216 and 312 to show when the stages of either have been overloaded.

In the foregoing description the values of $V_i$ representing the slopes of the straight line sections were entered manually along with the values of $N_i$ and $C_i$ it will be appreciated that slopes of the section *c* say, may be expressed as $(C_3-C_2)/(N_3-N_2)$ and circuitry could be incorporated to calculate the values of $V_i$ from relevant settings of $N_i$ and $C_i$. Such an arrangement makes simple the programming of a transfer function into the circuit arrangement by merely selecting the break point values of $y_i$ and $x_i$ (as represented by constants $C_i$ and counts $N_i$ respectively) of the function without knowing the gradients of the straight line sections.

In an alternative arrangement the detector means 210 may be connected to an output of the counter 310 the output of the counter being supplied to a different detector each time that the count is reset. In opertion each detector is concerned only with the number of pulses counted for one particular straight-line section and produces an output signal when the section is complete. Production of such a signal causes the counter 310 to be reset to count pulses for the next straight-line section and causes the counter output for that section to be fed to the next detector. Until the next detector produces an output signal the previously produced output signal is maintained.

In some applications it may be required for the break-points to be separated by a factor-of-two that is $x_i = 2x_{i-1}$ for all values of i; in such a case the requisite number of the most signficant stages of the counter 310 producing a binary output may be used as level detectors instead of detection means 210. The detection means 210 may be used in such an arrangement in addition to the counter to provide break-points not having a factor-of-two relationships.

Also in the above example, the function of x chosen was represented for four straight-line sections. Any function can be approximated by a suitable number of straight-line sections, requiring an additional detector 210, section of store 200, stage of D/A converter 230 and gradient voltage source 240 for each additional break-point.

Figure 4:
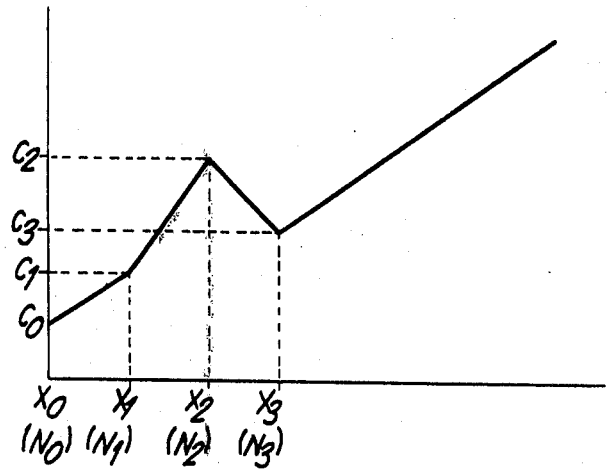
FIG. 4 shows the waveform of a typical output signal of the apparatus of FIG. 2.

Also, in the function illustrated for the purposes of description the straight-line sections all have a positive slope. The circuit arrangement of FIG. 2 may be adapted to handle a negative slope such as that appearing in the transfer function illustrated in FIG. 4. In such an arrangement the value of the constant $C_3$ is arranged to be less than $C_2$ and the output of the detector 213 is arranged to cause the counter 310 to count down from a preset value in response to the oscillator pulses, output from the next detector 214 returning the counter to zero and causing it to count upwards.

Figure 5:
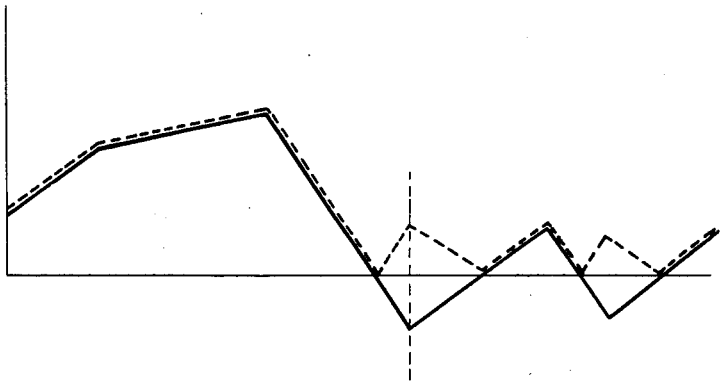
FIG. 5 shows a further form of transfer function.

If the transfer function is such that the value of *y* is required to take negative values as shown by the unbroken lines in the relationship shown in FIG. 5 the amplifier 410 may be provided with both inverting and non-inverting inputs (not shown). The function generated is that shown by the broken lines in the Figure in that the modulus of each break-point is used and additional break-points employed where the function changes sign. The inputs to the amplifier 410 are gated by the signal on the line 233 becoming zero at the additional break-points to switch the signal between input terminals of the amplifier and provide a negative-going output signal for negative values of the function.

Alternatively the input to the amplifier 410 can be biased by a constant negative signal to displace the transfer function in the *y*-direction such that a function generated in the wholly positive quadrant is able to produce both positive and negative values of *y*.

Figure 6:
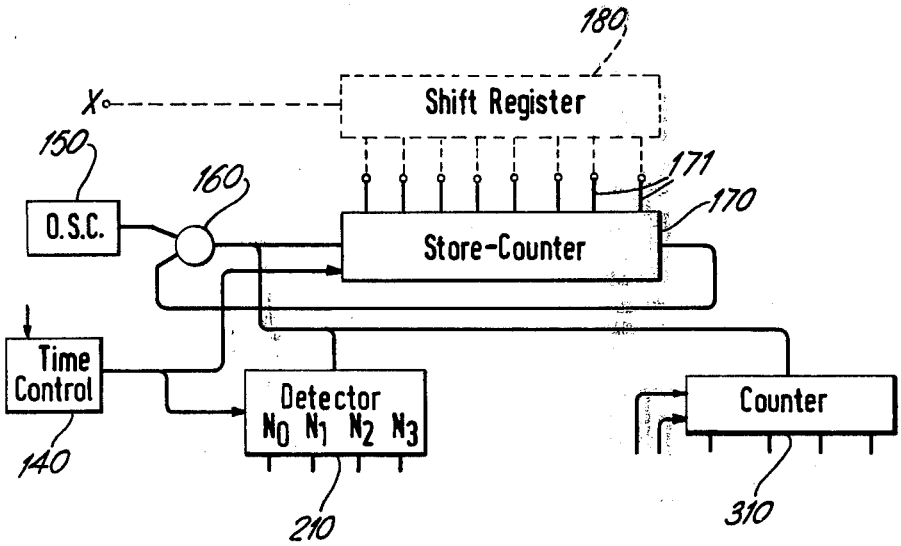
FIg. 6 shows a modified form of part of the block circuit diagram of FIG. 2.

The circuit arrangement of FIG. 2 and operation thereof has been described in which the input signal is in analogue form. If the input signal is alredy available as a pulse rate the oscillator 120 is not required. Alternatively the input means may be modified as shown in FIG. 6 in which form the apparatus is capable of receiving an input signal in a pure binary or coded binary parallel form. Referring to FIG. 6 the input means comprises an oscillator 150, gating means 160 and a store counter 170. The store counter 170 has a plurality of input terminals 171 by way of which a binary input number, comprising the information input signal, is loaded and stored. The oscillator feeds a continuous train of pulses by way of the gating means 160 to the store-counter which counts down from the stored number. A zero detector in the counter provides an output signal to close the gating means when the stored number of pulses have been passed through. The output of the gating means is applied to the detection means 210 and 310 in place of the output of the gating means 130 shown in FIG. 2. It will be appreciated that for any binary number a train of pulses will be provided having a number of pulses representative of the value of the binary number. If the information input signal is in serial form this may be entered into the store-counter 170 by way of a shift register 180 (shown ghosted in FIG. 6).

It will also be appreciated that in this case the control timing element 140 is no longer required for the purpose of determining the number of pulses in each sampling period as this number is a function of the input signal and the oscillator frequency. The timing element may therefore be triggered to provide a new sampling period each time that a new value of input signal is presented or may be retained to provide control at fixed duration sampling periods as previously, means then being provided to inhibit operation if the value of the input signal is changing. If the information is contained in other than pure binary form, for example, Gray code or binary coded decimal, then this may be converted to binary before application to the store-counter 170 or shift register 180, as appropriate.

The storage means 220 and 320 may be omitted if the switches of the digital-to-analogue converters are caused to latch in on one state by the appropriate detection or counter signals at the end of the sampling period and reset before the application of signals at the end of the next sampling period.

The invention as described may be employed to perform mathmatical processes in accordance with a set of different transfer functions or in evaluating the effect of a particular transfer function on a system. Alternatively it may be employed with a fixed transfer function to generate a non-linear relationship between two variables, for example between a vehicle road-speed and vehicle engine throttle-angle, or may be employed to linearise a non-linear relationship, for example output signals of transducers such as thermocouples and pressure transducers. The invention may also be employed in combination with a digital computer, in which an unacceptable amount of store is being utilised to store 'look-up' tables by which information is weighted; the use of the invention frees the store to enable the machine to perform more complex calculations.

What we claim is:

1. Signal processing apparatus for weighting an input signal in accordance with a predetermined mathematical transfer function represented by a plurality of straight lines each of which intersects the next at a separate brak-point, the apparatus comprising control means operable to define a succession of sampling periods of equal duration, input means responsive to an input signal in digital form comprising an oscillator operable to provide a continuous train of pulses at a constant repetition frequency such that the number of pulses generated during a sampling period represents the magnitude of the input signal, detection means defining the number of pulses corresponding to each successive break-point and responsive to the number of pulses occurring during a sampling period to produce a break-point signal identifying the highest break-point defined by said number of pulses, means responsive to the break-point signal to produce a gradient signal indicative of the slope of the straight line joining the said identified break-point to the next higher break-point, programmable counting means including a counter operable in each sampling period to count the number of oscillator pulses occurring in excess of the number identifying the break-point and produce an output after a preset number of pulses have been counted, gating means operable to pass pulses from the oscillator to the counter and to the detection means and responsive to the output from the counter to inhibit passage of the oscillator pulses for the remainder of the sampling period, means responsive to the number of pulses counted and to the gradient signal to provide an intermediate signal representative of the product of the input signal, in excess of the break-point, and the slope of the straight line section, and output means operable to deliver an output signal representative of the sum of the break-point signal and the intermediate signal.

2. Signal processing apparatus as claimed in claim 1 in which the oscillator is responsive to an analogue input signal to produce said continuous train of pulses, the pulse repetition frequency of said oscillator being determined by the magnitude of the input signal, and said gating means being responsive to the control means to pass the oscillator pulses during sampling periods.

3. Signal processing apparatus as claimed in claim 1 in which the detection means comprises a plurality of pulse-count detectors different detectors being associated with different break points of th function and operable to count different preset numbers of pulses of the pulse train to provide detection signals, the total number of pulses counted to produce each of the detection signals identifying the break points of the function, the detectors being arranged such that the detection signal of any detector is maintained until another detector produces a detection signal identifying the next higher break point, a source of reference voltage, and a digital-to-analogue converter comprising a plurality of switches associated each with a corresponding different one of the detectors, each switch being responsive to a detection signal from the associated detector at the end of a sampling period to apply a predetermined fraction of the reference voltage to an impedance network to produce an analogue break-point signal related in magnitude of the reference voltage and indicative of the highest break point defined the number of pulses in the sampling period.

4. Signal processing apparatus as claimed in claim 3 including means to maintain the detection signal current at the end of a sampling period for the duration of the next sampling period comprising storage means intermediate the detectors and the digital-to-analogue converter having a plurality of sections, individual sections being connected to corresponding different detectors and switches and operable to store the detection signal current at the end of the sampling period and to apply that signal to the corresponding switch of the digital-to-analogue converter for the duration of the next sampling period.

5. Signal processing apparatus as claimed in claim 3 in which the pulse train of the input signal is applied to all of the pulse count detectors, individual counters being aranged to be pre-set to count different total numbers of pulses identifying the break-points of the function.

6. Signal processing apparatus as claimed in claim 3 in which the detectors are arranged to be preset to count numbers of pulses indicative of the differences between successive break-points of the function, there being provided distribution means operable to direct the pulse train to one pulse-count detector at a time and responsive each time that a detection signal, indicative of a break-point, is produced by the detector to direct subsequent pulses of the train to the detector associated with the next break-point of the function and to inhibit a detection signal indicative of a preceding break-point.

7. Signal processing apparatus as claimed in claim 1 in which the means for providing the gradient signal comprises a plurality of voltage sources each source being connected to receive an output signal from a corresponding different counter of the detection means and responsive to the reception of an output signal from a corresponding counter at the end of each sampling period to provide a voltage, representative of the gradient of the straight line section of the transfer function from the highest break point reached in the sampling period. for the duration of the next sampling period.

8. Signal processing apparatus as claimed in claim 1 in which the counter to which the pulse train from the oscillator is applied for each sampling period, the total count being provided in parallel form at a plurality of output terminals, and counter resetting means responsive to the indication of each break-point by the detection means to enter a predetermined number into the counter, subsequent oscillator pulses being added algebraically to the total.

9. Signal processing apparatus as claimed in claim 8 in which the means to provide an intermediate signal comprises a digital-to-analogue converter comprising a plurality of switches each connected to the means for producing a gradient signal and each responsive to an output at a corresponding different output terminal of the counter at the end of the sampling period to connect the gradient signal to an impedance network to produce an analogue intermediate signal related in magnitude to the number of pulses counted between the last detected break-point and the end of the sampling-period.

10. Signal processing apparatus as claimed in claim 9 including means to maintain the counter output current at the end of the sampling period for the duration of the next sampling period.

11. Signal processing apparatus as claimed in claim 10 in which the means for maintaining the counter output comprises storage means intermediate the counter and the digital-to-analogue converter and operable at the end of the sampling period to store the signal representing the count and to apply that signal to the digital-to-analogue converter for the duration of the next sampling period.

12. Signal processing apparatus as claimed in claim 1 in which the detection means and/or the counter means includes overflow means operable to provide an indication of the number of pulses of the input signal exceeding the capacity of the detection means and/or the counting means respectively.

13. Signal processing apparatus as claimed in claim 1 in which when the transfer function has negative values the modulus of the transfer function is processed, there being provided additional break-points corresponding to the transfer function becoming negative, the signal processing apparatus including zero-crossing detection means responsive to the output signal reaching zero to invert the output signal between pairs of the additional break-points to produce an output signal having negative values.

14. Signal processing apparatus as claimed in claim 1 including means to add a constant to the value of each break-point such that the transfer function is wholly positive and means to subtract a corresponding constant value from the output signal.

* * * * *